US009156262B2

(12) United States Patent
Taff et al.

(10) Patent No.: US 9,156,262 B2
(45) Date of Patent: Oct. 13, 2015

(54) FLUID EJECTION DEVICE WITH TWO-LAYER TOPHAT

(75) Inventors: Brian M. Taff, Portland, OR (US); Michael Hager, Sweet Home, OR (US); Jason Oak, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/376,099

(22) PCT Filed: Apr. 27, 2012

(86) PCT No.: PCT/US2012/035556

§ 371 (c)(1), (2), (4) Date: Nov. 4, 2014

(87) PCT Pub. No.: WO2013/162606

PCT Pub. Date: Oct. 31, 2013

(65) Prior Publication Data

US 2015/0049141 A1 Feb. 19, 2015

(51) Int. Cl.
*B41J 2/18* (2006.01)
*B41J 2/14* (2006.01)

(52) U.S. Cl.
CPC ..... *B41J 2/1433* (2013.01); *B41J 2/1404* (2013.01); *B41J 2002/14403* (2013.01); *B41J 2002/14467* (2013.01)

(58) Field of Classification Search
USPC ..... 347/89, 65, 84, 67, 54
See application file for complete search history.

(56) References Cited

U.S. PATENT DOCUMENTS

2008/0198208 A1* 8/2008 Kyoso et al. ..... 347/85
2008/0238980 A1* 10/2008 Nagashima et al. ..... 347/17
2012/0007921 A1 1/2012 Govyadinov et al.

FOREIGN PATENT DOCUMENTS

EP 1525983 A1 4/2005
WO WO2011-146069 A1 11/2011
WO WO2012-008978 A1 1/2012

OTHER PUBLICATIONS

International Search Report and Written Opinion for Application No. PCT/US2012/035556, Dec. 26, 2012, 8 pages.

* cited by examiner

*Primary Examiner* — Henok Legesse
(74) *Attorney, Agent, or Firm* — Hewlett-Packard Patent Department

(57) ABSTRACT

In an embodiment, a fluid ejection device includes a substrate with a fluid slot, and a chamber layer over the substrate that defines a firing chamber and a fluidic channel extending through the firing chamber and in fluid communication with the slot at first and second ends. The device includes a tophat layer formed as a two-layer stack over the chamber layer, and a nozzle bore over the firing chamber that comprises a greater cavity formed in a first layer of the stack and a lesser cavity formed in a second layer of the stack, the greater cavity encompasses a larger volume than the lesser cavity.

6 Claims, 8 Drawing Sheets

FLUID EJECTION DEVICE WITH TWO-LAYER TOPHAT

BACKGROUND

Fluid ejection devices in inkjet printers provide drop-on-demand ejection of fluid drops. Inkjet printers produce images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

When nozzles sit exposed to ambient atmospheric conditions while in idle non-jetting states, evaporative water loss through the nozzle bores can alter the local composition of ink volumes within the bores, the firing chambers, and in some cases, beyond an inlet pinch toward the shelf/trench (ink slot) interface. Following periods of nozzle inactivity, the variation in properties of these localized volumes can modify drop ejection dynamics (e.g., drop trajectories, velocities, shapes and colors). When printing resumes after an inactive, non-jetting period, there is an inherent delay before the local ink volumes within the nozzle bores are refreshed. This delay, and the associated effects on drop ejection dynamics following a non-jetting period, are collectively referred to as decap response. Continued improvement of inkjet printers and other fluid ejection systems relies in part on mitigating decap response issues.

BRIEF DESCRIPTION OF THE DRAWINGS

The present embodiments will now be described, by way of example, with reference to the accompanying drawings, in which.

DETAILED DESCRIPTION

Overview

Figure 1:
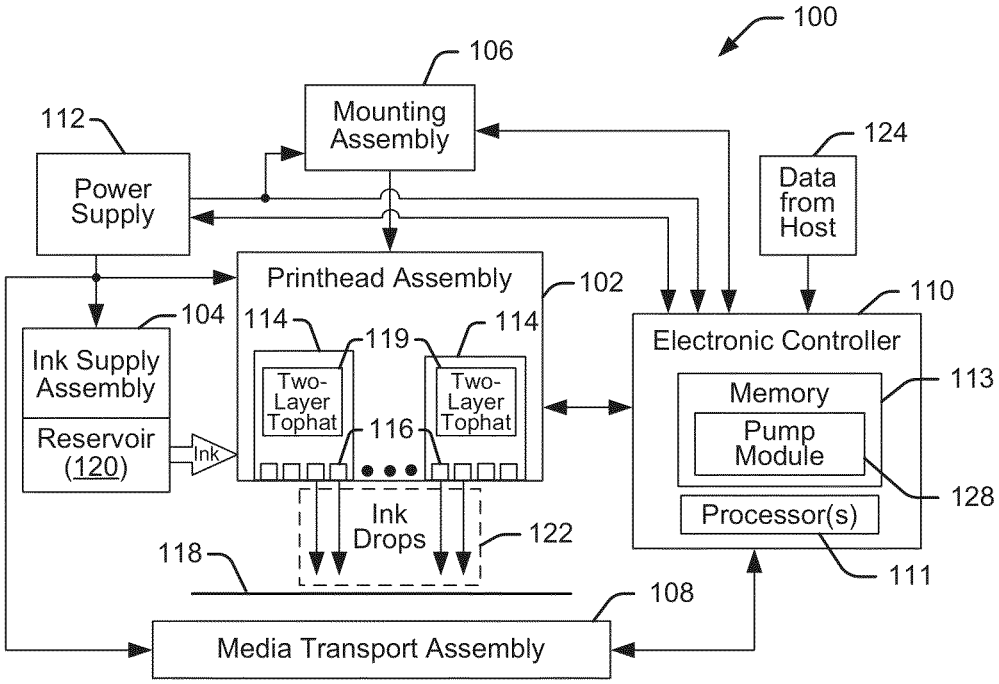
FIG. 1 illustrates a fluid ejection system implemented as an inkjet printing system, according to an embodiment.

As noted above, decap response impacts stagnant ink volumes local to the nozzle bores, firing chambers, and other nearby areas within fluid ejection devices that interface with the surrounding environment during non-jetting, idle spans. In general, decap behaviors tend to manifest in the form of Pigment Ink Vehicle Separation (PIVS) and viscous plug dependent modes that create "first-drop-out" print quality complications. In the PIVS decap mode, water evaporation at the exposed bore creates a localized enrichment in non-volatile ink species within the bore and/or device firing chamber. This region-specific modification in the ink composition depletes the local in-chamber and/or in-bore ink volumes of their pigment content. When a nozzle affected by this dynamic returns to activity, the first drops ejected from the nozzle do not contain the same coloration as that of bulk renewed ink, which impacts the quality of the resultant printed drops on the page. Similarly, the viscous plug decap mode stems from the evaporation-driven "thickening" or "hardening" of ink stationed within the bore (and in some cases within the chamber as well) due to the depletion of in-ink water molecules and the subsequent elevation in the local ink viscosity. This type of decap response impacts the drop ejection dynamic and can result in drops that are misdirected, drops with reduced velocities, and in some cases, no drops at all.

Prior methods of mitigating the decap response have focused mostly on ink formulation chemistries, minor architecture adjustments, tuning nozzle firing parameters, and/or servicing algorithms. These approaches have often been directed toward specific printer/platform implementations, however, and have therefore not provided a universally suitable solution.

Efforts to mitigate the decap response through adjustments in ink formulation, for example, often rely upon the inclusion of key additives that offer benefits only when paired with specific dispersion chemistries. Architecture focused strategies have typically leveraged shortened shelves (i.e., the length from the center of the firing resistor to the edge of the incoming ink-feed slot), the inclusion or exclusion of counter bores, and modifications to resistor sizes. These techniques, however, usually provide only minimal performance gains. Fire pulse routines have shown some improvements in targeted architectures when exercised as sub-TOE (turn on energy) mixing protocols for stirring ink within the nozzle to combat Pigment Ink Vehicle Separation (PIVS) forms of the decap dynamic, or by delivering more energetic stimulation of in-chamber ink volumes (delivered at higher voltages or through modified precursor pulse configurations) to compete against viscous plugging forms of the decap response. Again, however, this strategy provides only marginal gains in specific non-universal contexts. Servicing algorithms have functioned as the main systems-based fix. However, servicing algorithms typically generate waste ink and associated waste ink storage issues, in-printer aerosol, and print/wipe protocols that are only feasible for implementation as pre- or post-job exercises.

Embodiments of the present disclosure mitigate the decap response more generally through a systems-level, hardware approach that moves beyond currently available strategies for offsetting PIVS-based decap modes, to directly address the viscous plug based variety of decap response. This approach implements a composite, multi-level bore fabrication to create new types of in-nozzle flow channels that enable bulk ink supplies to be swept through portions of the bore. A standard, single tophat layer is partitioned into a two-layer stack with a first layer having flow channel features that funnel portions of a die-level recirculation flow through the nozzle bore. The second layer of the two-layer tophat stack functions to define a nozzle bore outlet in a manner similar to a traditional tophat layer.

There are various techniques that may be suitable to generate die-level fluid circulation. While die-level fluid circulation is integral to the concepts disclosed herein for achieving in-nozzle or thru-bore fluid flow, the techniques for generating such circulation are not the focus of this disclosure. Briefly, such techniques can include, for example, the integration of fluid-actuator-driven inertial pumps into primary fluid recirculation channels. The selective activation of fluid actuators integrated within fluidic channels at asymmetric locations (e.g., toward channel ends) can generate both unidirectional and bidirectional fluid flow through the channels. Depending on the actuator mechanism employed, temporal control over the mechanical operation or motion of the actuator can also provide directional control of fluid flow through a fluidic channel. Fluid actuators can be driven by a variety of actuator mechanisms such as thermal bubble resistor actuators, piezo membrane actuators, electrostatic (MEMS) membrane actuators, mechanical/impact driven membrane actuators, voice coil actuators, magneto-strictive drive actuators, alternating current electro-osmotic (ACEO) pump mechanisms, and so on. The fluid actuators can be integrated into the channels of microfluidic systems (e.g., fluid ejection devices) using conventional microfabrication processes. Other techniques for generating die-level fluid circulation include pressure differentials driven by off-die mechanisms such as an external pneumatic pump or syringe. Such mechanisms, however, are typically bulky, difficult to handle and program, and have unreliable connections.

Within fluid ejection devices, these and other die-level recirculation techniques can be useful in sweeping refreshed ink through the fluid/ink firing chambers. The presently disclosed thru-bore ink renewal approach, however, directly combats the evaporation-driven formation of in-bore viscous plug formation. This strategy expands the reach of prior printer systems-based avenues for managing the print output complications affiliated with the decap dynamic, and puts within reach the ideal of an "instant ON" nozzle that does not demand a series of refresh spits or servicing routines to ensure that the first drops printed following idle, non-jetting spans, are well matched to reference line quality.

In one example embodiment, a fluid ejection device includes a substrate with a fluid slot, and a chamber layer over the substrate that defines a firing chamber. The chamber layer also defines a fluidic channel that extends through the firing chamber and that is in fluid communication with the slot at first and second channel ends. The fluid ejection device includes a tophat layer formed as a two-layer stack over the chamber layer. Within the two-layer stack, a nozzle bore is formed over the firing chamber that comprises a greater cavity formed in a first layer of the stack and a lesser cavity formed in a second layer of the stack. The greater cavity of the nozzle bore encompasses a larger volume than the lesser cavity.

In another example embodiment, a fluid ejection device includes a substrate with a fluid slot, and a chamber layer over the substrate that defines a discontinuous channel having first and second parts. The device includes a two-layer tophat having first and second layers over the chamber layer. A notch channel is formed in the first layer to fluidically couple the first and second parts of the discontinuous channel. A nozzle bore formed in the two-layer tophat has a greater cavity formed in the first layer and a lesser cavity formed in the second layer. The device also includes a conduit formed in the first layer to fluidically couple the notch channel with the greater cavity of the nozzle bore.

In another example embodiment, a fluid ejection device includes a substrate with two fluid slots, and a chamber layer over the substrate that defines a firing chamber and a fluidic channel extending between the two fluid slots and through the firing chamber. A tophat layer is formed as a two-layer stack over the chamber layer, and a nozzle bore over the firing chamber includes a greater cavity formed in a first layer of the stack and a lesser cavity formed in a second layer of the stack, the greater cavity encompassing a larger volume than the lesser cavity.

Illustrative Embodiments

FIG. 1 illustrates a fluid ejection system implemented as an inkjet printing system 100, according to an embodiment of the disclosure. Inkjet printing system 100 generally includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. In this embodiment, fluid ejection devices 114 are implemented as fluid drop jetting printheads 114. Inkjet printhead assembly 102 includes at least one fluid drop jetting printhead 114 that ejects drops of ink through a plurality of orifices or nozzles 116 toward print media 118 so as to print onto the print media 118. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other. Print media 118 can be any type of suitable sheet or roll material, such as paper, card stock, transparencies, Mylar, and the like. As further discussed below, each printhead 114 comprises a two-layer tophat layer 119 having flow channel features that funnel portions of die-level recirculation flow through nozzle bores.

Ink supply assembly 104 supplies fluid ink to printhead assembly 102 and includes a reservoir 120 for storing ink. Ink flows from reservoir 120 to inkjet printhead assembly 102. Ink supply assembly 104 and inkjet printhead assembly 102 can form either a one-way ink delivery system or a macro-recirculating ink delivery system. In a one-way ink delivery system, substantially all of the ink supplied to inkjet printhead assembly 102 is consumed during printing. In a macro-recirculating ink delivery system, however, only a portion of the ink supplied to printhead assembly 102 is consumed during printing. Ink not consumed during printing is returned to ink supply assembly 104.

In some implementations, inkjet printhead assembly 102 and ink supply assembly 104 are housed together in an inkjet cartridge or pen. In other implementations, ink supply assembly 104 is separate from inkjet printhead assembly 102 and supplies ink to inkjet printhead assembly 102 through an interface connection, such as a supply tube. In either implementation, reservoir 120 of ink supply assembly 104 may be removed, replaced, and/or refilled. Where inkjet printhead assembly 102 and ink supply assembly 104 are housed together in an inkjet cartridge, reservoir 120 can include a local reservoir located within the cartridge as well as a larger reservoir located separately from the cartridge. A separate, larger reservoir serves to refill the local reservoir. Accordingly, a separate, larger reservoir and/or the local reservoir may be removed, replaced, and/or refilled.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one implementation, inkjet printhead assembly 102 is a scanning type printhead assembly. As such, mounting assembly 106 includes a carriage for moving inkjet printhead assembly 102 relative to media transport assembly 108 to scan print media 118. In another implementation, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

In one implementation, inkjet printhead assembly 102 includes one printhead 114. In another implementation, inkjet printhead assembly 102 is a wide-array assembly with multiple printheads 114. In wide-array assemblies, an inkjet printhead assembly 102 typically includes a carrier that carries printheads 114, provides electrical communication between printheads 114 and electronic controller 110, and provides fluidic communication between printheads 114 and ink supply assembly 104.

In one embodiment, inkjet printing system 100 is a drop-on-demand thermal bubble inkjet printing system where the printhead(s) 114 is a thermal inkjet (TIJ) printhead. The TIJ printhead implements a thermal resistor ejection element in an ink chamber to vaporize ink and create bubbles that force ink or other fluid drops out of a nozzle 116. In another embodiment, inkjet printing system 100 is a drop-on-demand piezoelectric inkjet printing system where the printhead(s) 114 is a piezoelectric inkjet (PIJ) printhead that implements a piezoelectric material actuator as an ejection element to generate pressure pulses that force ink drops out of a nozzle.

Electronic printer controller 110 typically includes one or more processors 111, firmware, software, one or more computer/processor-readable memory components 113 including volatile and non-volatile memory components (i.e., non-transitory tangible media), and other printer electronics for communicating with and controlling inkjet printhead assembly 102, mounting assembly 106, and media transport assembly 108. Electronic controller 110 receives data 124 from a host system, such as a computer, and temporarily stores data 124 in a memory 113. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one implementation, electronic printer controller 110 controls inkjet printhead assembly 102 for ejection of ink drops from nozzles 116. Thus, electronic controller 110 defines a pattern of ejected ink drops that form characters, symbols, and/or other graphics or images on print media 118. The pattern of ejected ink drops is determined by the print job commands and/or command parameters.

In one implementation, electronic controller 110 includes a fluid pump module 128 stored in a memory 113 of controller 110. Pump module 128 includes coded instructions executable by one or more processors 111 of controller 110 to cause the processor(s) 111 to implement various functions of a fluidic pump (not shown in FIG. 1) operable within the fluidic channels of printhead 114 to generate die-level fluid flow that circulates fluid through the fluidic channels. Pump module 128 manages, for example, the direction, rate, and timing of fluid flow through the channels. A fluidic pump may include various types of pump actuators including, for example, a resistor pump that generates fluid displacement by heating fluid to create an expanding and contracting vapor bubble, a piezoelectric material actuator that generates pressure pulses, and an alternating current electro-osmotic (ACEO) pump mechanism that generates a net flow of fluid through the electrical stimulation of electrodes within the fluidic channels of the printhead 114. In some implementations, fluidic circulation through channels of printhead 114 can be achieved using off-die pressure differentials.

Figure 2A:
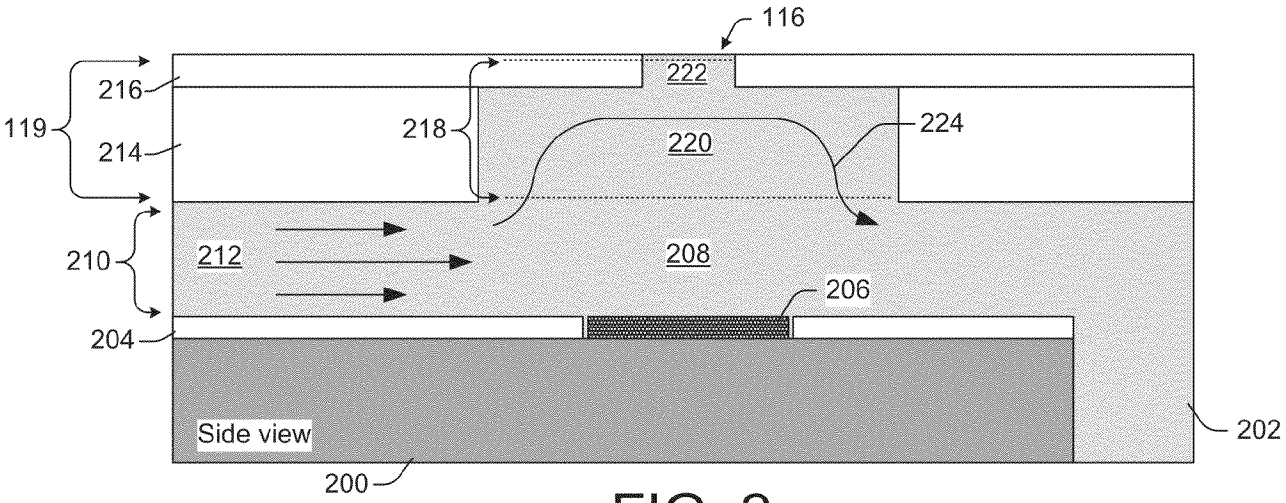
FIGS. 2*a* and 2*b* show, respectively, a side view and a plan view of a portion of an example fluid ejection device, according to an embodiment.
Figure 2B:
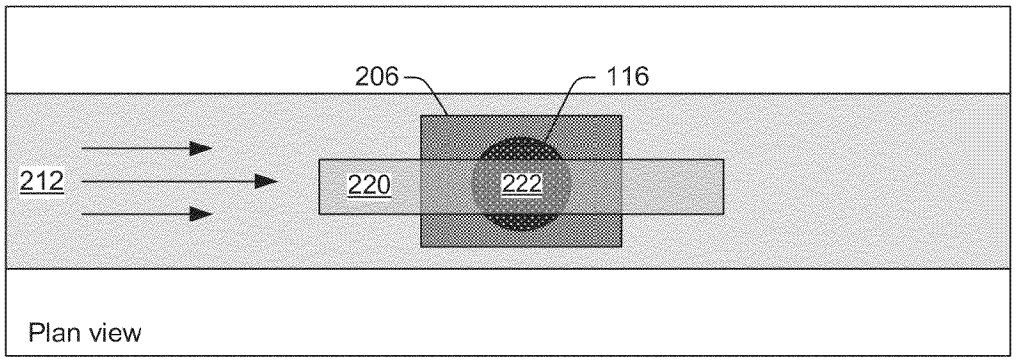

FIG. 2 shows a side view (FIG. 2*a*) and a plan view (FIG. 2*b*) of a portion of an example fluid ejection device 114 (i.e., printhead 114), according to an embodiment of the disclosure. The portion of printhead 114 illustrated in FIG. 2 is the drop generator portion where fluid/ink drops are ejected from the printhead 114 through a nozzle 116. Printhead 114 is formed in part, of a layered architecture that includes a substrate 200 (e.g., glass, silicon) with a fluid slot 202 or trench formed therein. In general, features of printhead 114 such as fluid slot 202 are formed using various precision microfabrication techniques such as electroforming, laser ablation, anisotropic etching, sputtering, spin coating, dry etching, photolithography, casting, molding, stamping, machining, and the like.

Referring again to FIG. 2, printhead 114 further includes a primer layer 204 over the substrate 200. Primer layer 204 is typically formed of SU8 epoxy but can also be made of other materials such as a polyimide. Also formed on the substrate 200 is a firing resistor 206 that ejects ink drops through nozzle 116 by heating a small layer of surrounding fluid within a chamber 208, which creates a vapor bubble that forces ink out of the nozzle 116. Chamber 208 is defined by a chamber layer 210 that is formed over primer layer 204 and the substrate 200. The chamber layer 210 also defines a fluidic channel 212 which is the primary flow path for ink flowing to and from the fluid slot 202, as shown, for example, in FIG. 3. The primary fluid flow path through chamber layer 210 (i.e., fluidic channel 212) is illustrated in FIG. 2*a* by three straight arrows. The material forming chamber layer 210 is not shown in FIG. 2 (i.e., only the fluidic channel 212 and chamber 208 defined by the chamber layer 210 are shown). However, like primer layer 204, the chamber layer 210 is typically formed of SU8 epoxy but can also be made of other materials such as a polyimide.

A two-layer tophat layer 119 is formed over chamber layer 210. The two-layer tophat 119 forms a two-layer stack that includes a first layer 214 and a second layer 216. Thus, the first layer 214 is an interim layer within the two-layer tophat 119 positioned between the second layer 216 (i.e., the topmost layer) of the two-layer tophat 119 and the chamber layer 210. The thickness of the two-layer tophat layer 119 is on the order of 20 microns. However, the thickness may be more or less than 20 microns in some implementations. The thickness of the first layer 214 is on the order of 15 microns, while the thickness of the second layer 216 is on the order of 5 microns. While these dimensions may vary in some implementations, the thickness of the first layer 214 of the two-layer tophat 119 is generally on the order of between 50-75% of the whole thickness of the two-layer tophat layer 119. The two-layer tophat layer 119 is typically formed of SU8 epoxy, but it can also be made of other materials such as a polyimide.

A dual-sized nozzle bore 218 is formed in the two-layer tophat 119 which spans both the first layer 214 and second layer 216 of the tophat layer 119. As shown in FIG. 2*a*, the dual-sized nozzle bore 218 includes two differently shaped cavities. The nozzle bore 218 includes a greater cavity 220 formed in the first layer 214 of the two-layer tophat 119 and a lesser cavity 222 formed in the second layer 216 of the two-layer tophat 119. The greater cavity 220 encompasses a larger volume than the lesser cavity 222. As shown in FIG. 2*b*, however, the volume encompassed by the greater cavity does not include the same width dimension as the underlying chamber 208. Rather, the greater cavity 220 is narrower in width than the underlying chamber 208.

Referring again to FIG. 2*a*, while the fluidic channel 212 in chamber layer 210 forms the primary fluid flow path for the die-level fluid circulation, the greater cavity 220 within nozzle bore 218 enables a secondary fluid flow path 224 that funnels a portion of the die-level fluid/ink flowing within fluidic channel 212 through the nozzle bore 218. This fluid flow through the nozzle bore 218 via the secondary path 224 is disruptive of stagnant fluid volumes within the nozzle region that can develop during periods when the nozzle 116 is idle and is not jetting fluid. The flow of fluid/ink through the nozzle bore 218 provides fresh, bulk ink volumes that mitigate the PIVS and viscous plug decap response modes and improve "first-drop-out" print quality from the printhead 114. As discussed below, other fluid flow features formed in the first/interim layer 214 of the two-layer tophat 119 provide additional fluid flow through the nozzle bore 218.

FIGS. 3-7 show examples of a fluid ejection device 114 (i.e., printhead 114) having different fluid flow features implemented within a two-layer tophat 119, according to embodiments of the disclosure. Each of the example printheads 114 in FIGS. 3-7 is illustrated using plan views that show separate views of the chamber layer 210 layout, the first layer 214 layout of the two-layer tophat 119, the second layer 216 layout of the two-layer tophat 119, and an overall design layout view that combines the various layers into a single view. Firing resistors 206 and, in some cases, pump actuators (e.g., pump resistors) are also shown in the overall design layout views.

Figure 3:
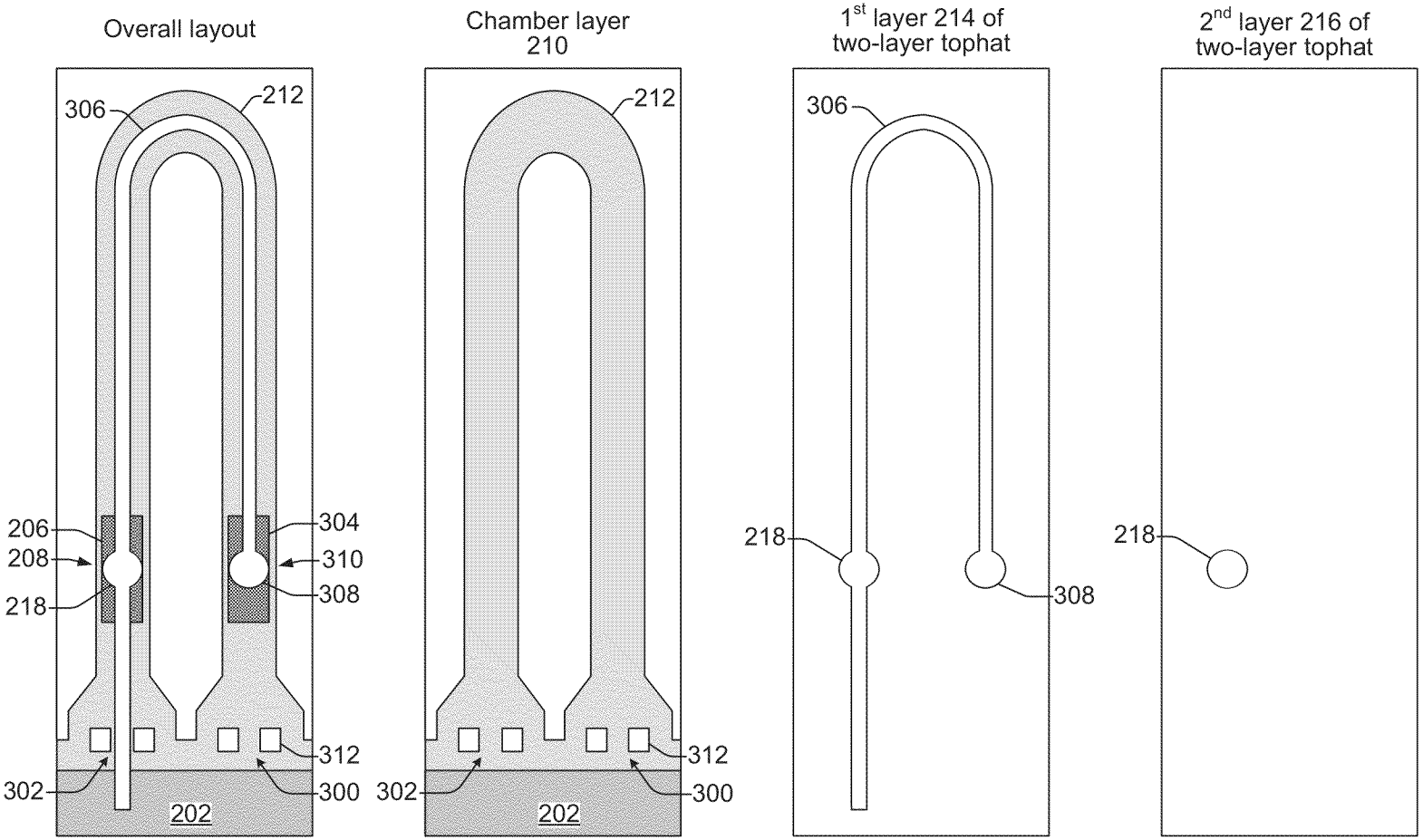
FIGS. 3-7 show examples of a fluid ejection device having different fluid flow features implemented within a two-layer tophat, according to different embodiments.

Referring to FIG. 3, the chamber layer 210 defines the firing chamber 208, a pump chamber 310, and the fluidic channel 212 which extends from the fluid slot 202 at a first end 300 of the channel 212, around to a second end 302 of the channel 212. The first and second channel ends (300, 302) can be referred to as the channel inlet 300 and channel outlet 302, respectively, depending on the direction of fluid flow through the channel 212. As noted above, the fluidic channel 212 in chamber layer 210 forms the primary fluid flow path for the die-level fluid circulation. As shown in the overall layout view of FIG. 3, a resistor pump 304 within pump chamber 310, for example, or another type of fluidic pump such as a piezoelectric actuator or ACEO pump, or an off-substrate mechanism that generates fluid pressure differentials, pumps fluid/ink from slot 202 at the channel inlet 300, through the channel 212 and the firing chamber 208, and back to the slot 202 through the channel outlet 302. In some implementations, printhead 114 also includes particle tolerant architectures 312. As used herein, particle tolerant architectures (PTA) refer to barrier objects placed in the fluid/ink path (e.g., channel inlet 300 and outlet 302) to help prevent particles such as dust and air bubbles from interrupting fluid/ink flow and from blocking ejection chambers and/or nozzles 116.

Figure 4A:
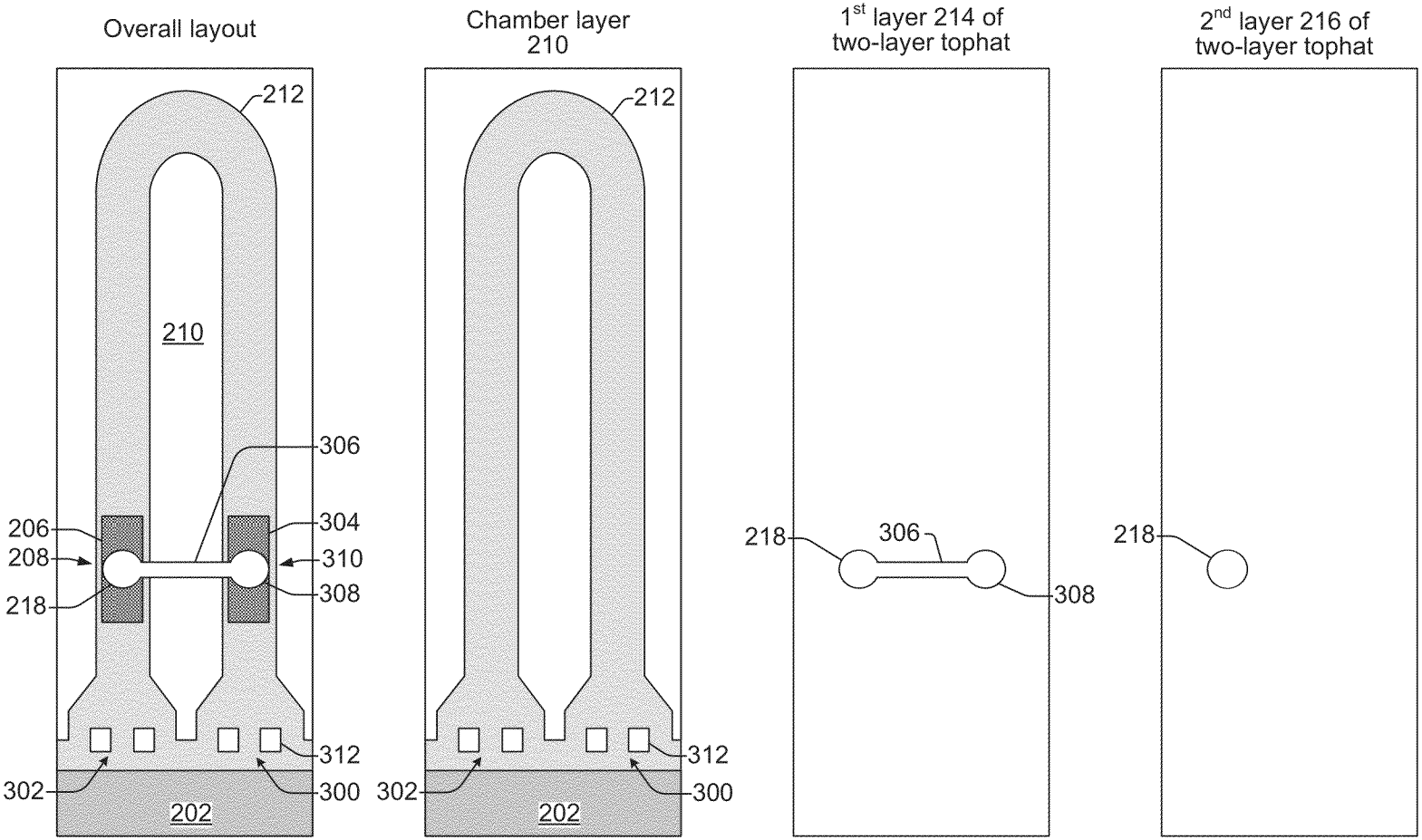

A fluid conduit 306 is formed in the first layer 214 of the two-layer tophat 119. In addition, a pump bore 308 is formed in the first layer 214 of the two-layer tophat 119 over the resistor pump 304. The fluid conduit 306 and pump bore 308 are shown in the first layer 214 view of FIG. 3, along with the nozzle bore 218, which includes the greater cavity 220 and lesser cavity 222, as discussed above with respect to FIG. 2. In the FIG. 3 implementation, the fluid conduit 306 extends from the pump bore 308 to the greater cavity 220 of the nozzle bore 218, following above the path of the fluidic channel 212. In other implementations, such as shown in FIG. 4*a*, the fluid conduit 306 extends from the pump bore 308 to the greater cavity 220 of the nozzle bore 218, but does not follow the path of the fluidic channel 212. The fluid conduit 306 intersects and runs through the greater cavity 220 of the nozzle bore 218 of FIG. 2. Put another way, the greater cavity 220 of the nozzle bore 218 forms a part of the fluid conduit 306 within the first layer 214 of the two-layer tophat 119. In addition, note that the fluid conduit 306 in this design and other designs can extend past the channel outlet 302 and out over the slot 202 region (i.e., beyond the particle tolerant architectures 312).

As fluid/ink is pumped by resistor pump 304 and circulates in a primary fluid flow around the fluidic channel 212, the fluid conduit 306 formed in the first layer 214 of the two-layer tophat 119 captures and routes some of the flow through the greater cavity 220 within nozzle bore 218. In addition, this design enables amounts of fluid/ink pumped by resistor pump 304 to flow directly from the pump bore 308, through the conduit 306, and into the nozzle bore 218 without traveling through the primary fluidic channel 212. Thus, fluid/ink flows through the nozzle bore 218 via a secondary path and provides bulk, refreshed ink volume that disrupts stagnant volumes within the nozzle region and improves the print quality of the first printed drops.

As noted above, FIG. 4 (FIGS. 4*a*, 4*b*) shows another implementation of a fluid conduit 306 formed in the first layer 214 of the two-layer tophat 119 of a printhead 114. Like the implementation in FIG. 3, the fluid conduit 306 and pump bore 308 are shown in the first layer 214 view of FIGS. 4*a* and 4*b*, along with the nozzle bore 218, which includes the greater cavity 220 and lesser cavity 222 as discussed above with respect to FIG. 2. In the FIG. 4*a* implementation, the fluid conduit 306 extends from the pump bore 308 to the greater cavity 220 of the nozzle bore 218, but does not follow along (i.e., above) the path of the fluidic channel 212. Instead, the conduit 306 in the FIG. 4*a* implementation spans directly across a portion of the chamber layer 210 to fluidically couple the pump bore 308 and nozzle bore 218 through the first layer 214 of the two-layer tophat 119. Therefore, unlike the design noted in FIG. 3, the fluid/ink that flows through the conduit 306 and into the nozzle bore 218, is not a part of the primary fluid flow circulating through the fluidic channel 212. Instead, in the FIG. 4*a* design, as the resistor pump 304 pumps fluid/ink to provide primary fluid circulation through the fluidic channel 212 and around to the firing chamber 208, virtually all of the fluid/ink that flushes through the greater cavity 220 of nozzle bore 218 flows directly through the fluid conduit 306 formed in the first layer 214 of the two-layer tophat 119. The fluid conduit 306 intersects and runs through the greater cavity 220 of the nozzle bore 218, and the greater cavity 220 forms a part of the fluid conduit 306 within the first layer 214 of the two-layer tophat 119.

Figure 4B:
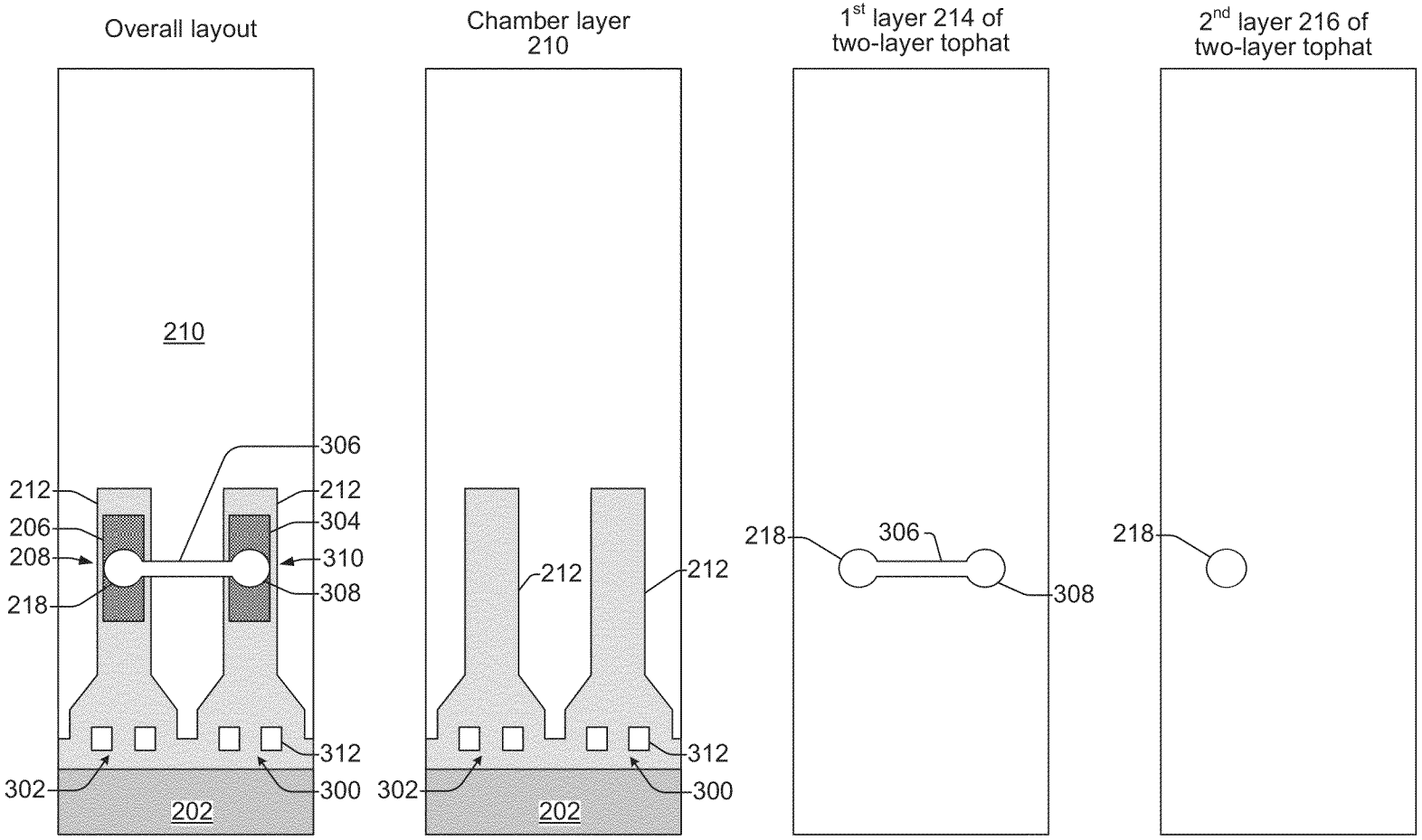

In the implementation shown in FIG. 4*b*, the fluidic channel 212 in chamber layer 210 is discontinuous, and does not extend through the chamber layer 210 between the pump chamber 310 and firing chamber 208. Therefore, the fluid flow generated by resistor pump 304 does not circulate between the pump chamber 310 and firing chamber 208 through the fluidic channel 212. Instead, all the fluid flow generated by resistor pump 304 circulates directly between the pump bore 308 and nozzle bore 218 through the fluid conduit 306.

Figure 5:
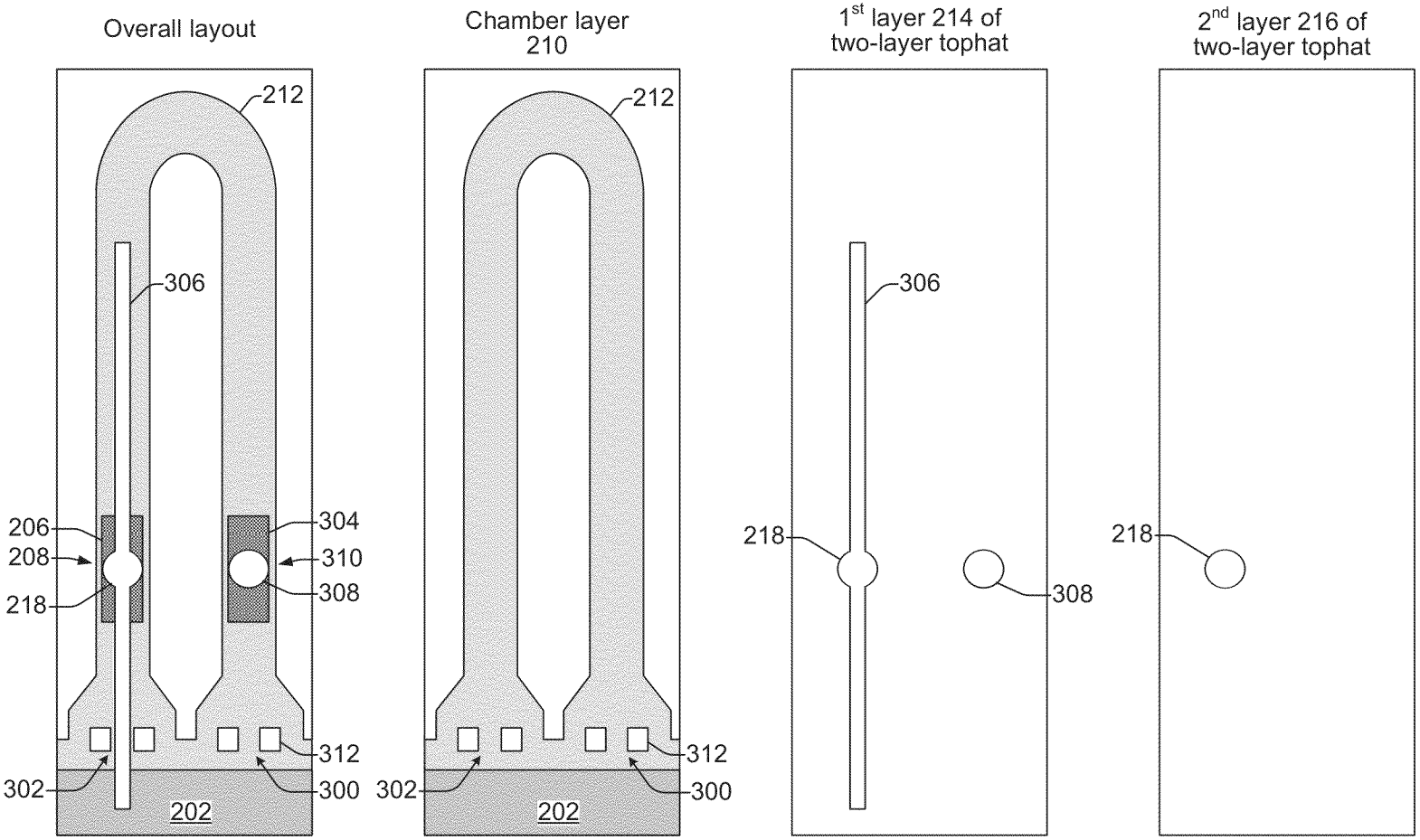

FIG. 5 shows another implementation of a fluid conduit 306 formed in the first layer 214 of the two-layer tophat 119 of a printhead 114. The fluid conduit 306 shown in the FIG. 5 implementation does not begin at the pump bore 308, and therefore does not extend from the pump bore 308 and resistor pump 304 to the nozzle bore 218. Instead, the fluid conduit 306 in the FIG. 5 implementation begins part way through the primary fluidic channel 212. In this design, therefore, the ink that flows through the fluid conduit 306 and into the greater cavity 220 of nozzle bore 218 funnels into the conduit 306 entirely from the die-level fluid flow circulating through the fluidic channel 212.

Figure 6:
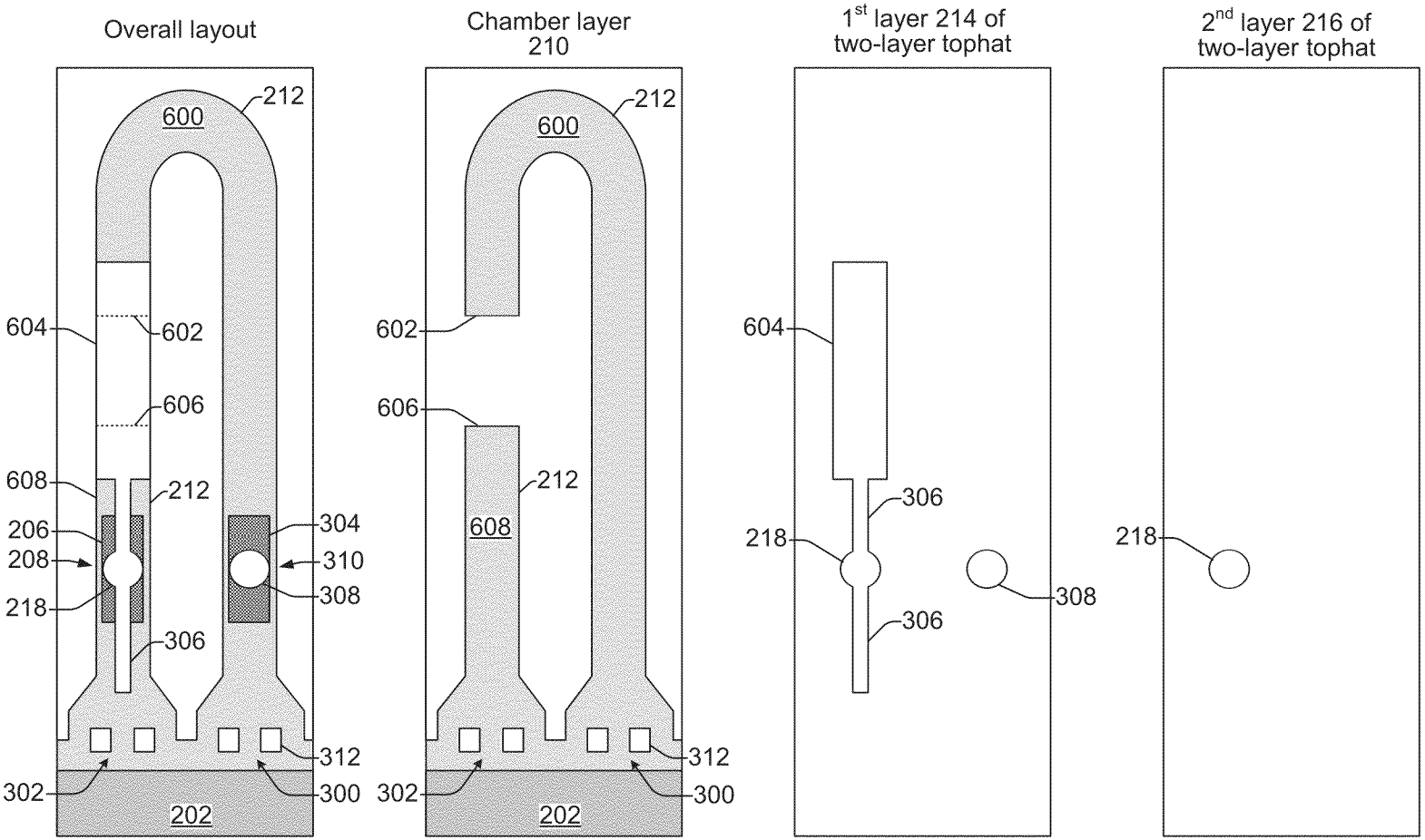

FIG. 6 shows yet another implementation of a fluid conduit 306 formed in the first layer 214 of the two-layer tophat 119 of a printhead 114. In this implementation, the chamber layer 210 defines a discontinuous fluidic channel 212. That is, a first part 600 of the discontinuous fluidic channel 212 extends from the channel inlet 300 through a portion of the chamber layer 210 and then it terminates 602. Above the channel 212, formed in the first layer 214 of the two-layer tophat 119, is a notch channel 604 having one end fluidically coupled to the terminal end 602 of the first part of fluidic channel 212. Thus, fluid flowing from the slot 202 at the channel inlet 300 can flow through the discontinuous channel 212 and then upward into the notch channel 604. The notch channel 604 extends a short distance through the first layer 214 of the two-layer tophat 119 and is then fluidically coupled at its other end to a beginning 606 of the second part 608 of the discontinuous fluidic channel 212. Thus, fluid flowing from the slot 202 at the channel inlet 300 can flow through the first part 600 of the discontinuous channel 212, and then upward into the notch channel 604, and then back down into the second part 608 of the discontinuous channel 212. The second part 608 of the discontinuous channel 212 extends through the firing chamber 208 and to the channel outlet 302. A conduit 306 formed in the first layer 214 then fluidically couples the notch channel 604 with the greater cavity 220 of nozzle bore 218. Therefore, fluid circulating from the action of a resistor pump 304 flows through the discontinuous channel 212 and through the notch channel 604 before flowing through the circulation conduit 306 and then through the nozzle bore 218.

Figure 7:
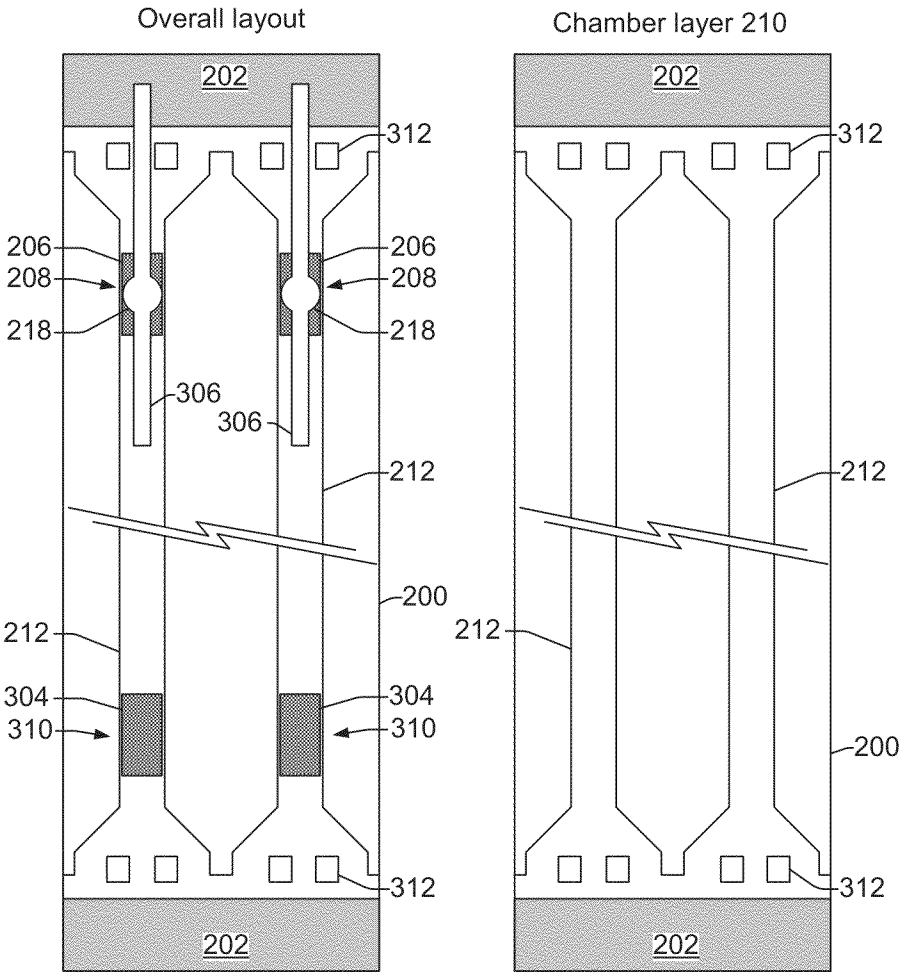

FIG. 7 shows another implementation of a fluid conduit 306 formed in the first layer 214 of the two-layer tophat 119 of a printhead 114. In this implementation, the chamber layer 210 defines fluidic channels 212 that extend across a central region of the substrate 200 between two fluid supply slots 202. Resistor pumps 304 along one slot 202 pump to circulate fluid/ink along a primary fluid path extending across the central region of the substrate 200 through fluidic channels 212 to the firing chambers 208 and then to the second slot 202. Note that while pump chambers 310 surround resistor pumps 304, there are no pump bores shown in this implementation. Circulation conduits 306 formed in the first layer 214 of two-layer tophat 119 pick up a portion of the circulating fluid and route it through the greater cavities 220 of nozzle bores 218. As in the previous designs discussed above, the circulating fluid/ink flows through the nozzle bore 218 via a secondary path and provides bulk, refreshed ink volume that disrupts stagnant volumes within the nozzle region and improves the print quality of the first printed drops.

What is claimed is:

1. A fluid ejection device comprising:

a substrate with a fluid slot;

a chamber layer over the substrate that defines a firing chamber, a pump chamber, and a fluidic channel in fluid communication with the slot at first and second ends, the channel extending through the firing chamber;

a tophat layer formed as a two-layer stack over the chamber layer;

a nozzle bore over the firing chamber that comprises a greater cavity formed in a first layer of the stack and a lesser cavity formed in a second layer of the stack, the greater cavity encompassing a larger volume than the lesser cavity; and a circulation conduit formed in the first layer following along and above the fluidic channel between the pump chamber and the firing chamber.

2. A fluid ejection device as in claim 1, wherein the circulation conduit is formed in the first layer to provide a fluid flow path through the greater cavity of the nozzle bore, wherein the conduit enters a first side of the greater cavity and exits a second side of the greater cavity.

3. A fluid ejection device as in claim 2, further comprising:

a pump bore formed in the first layer over the pump chamber, wherein the circulation conduit extends between the pump bore and the greater cavity of the nozzle bore; and a pump actuator formed on the substrate within the pump chamber to circulate fluid through the fluidic channel, the circulation conduit, and the greater cavity of the nozzle bore.

4. A fluid ejection device as in claim 3, wherein the circulation conduit fluidically couples the pump bore directly with the nozzle bore across a portion of the chamber layer without following the fluidic channel.

5. A fluid ejection device comprising:

a substrate with a fluid slot;

a chamber layer over the substrate that defines a firing chamber and a pump chamber, both chambers in fluid communication with the slot;

a tophat layer formed as a two-layer stack over the chamber layer;

a nozzle bore over the firing chamber that comprises a greater cavity formed in a first layer of the stack and a lesser cavity formed in a second layer of the stack, the greater cavity encompassing a larger volume than the lesser cavity;

a pump bore formed in the first layer over the pump chamber; and a circulation conduit formed in the first layer between the pump bore and the greater cavity of the nozzle bore.

6. A fluid ejection device as in claim 5, further comprising a pump actuator formed on the substrate within the pump chamber to circulate fluid through the circulation conduit between the pump bore and the greater cavity of the nozzle bore.

* * * * *